US009103113B2

(12) United States Patent
Lockhart

(10) Patent No.: US 9,103,113 B2
(45) Date of Patent: Aug. 11, 2015

(54) WALL STUD WITH A THERMAL BREAK

(76) Inventor: Stacy L. Lockhart, Missoula, MT (US)

( * ) Notice: Subject to any disclaimer, the term of this patent is extended or adjusted under 35 U.S.C. 154(b) by 0 days.

(21) Appl. No.: 13/077,355

(22) Filed: Mar. 31, 2011

(65) Prior Publication Data

US 2011/0239573 A1 Oct. 6, 2011

Related U.S. Application Data

(60) Provisional application No. 61/319,620, filed on Mar. 31, 2010, provisional application No. 61/324,826, filed on Apr. 16, 2010.

(51) Int. Cl.

| | |
|---|---|
| ***E04B 1/94*** | (2006.01) |
| ***E04C 3/29*** | (2006.01) |
| ***E04B 2/74*** | (2006.01) |
| ***E04C 3/36*** | (2006.01) |
| *B05B 1/00* | (2006.01) |
| *B05C 11/00* | (2006.01) |
| *B05C 13/00* | (2006.01) |

(52) U.S. Cl.

CPC ..... *E04B 2/7412* (2013.01); *E04B 2/7457* (2013.01); *E04C 3/36* (2013.01); *E04B 2/7411* (2013.01)

(58) Field of Classification Search

CPC ... E04B 2/7411; E04B 2/7412; E04B 2/7457; E04C 3/36

USPC ..... 52/404.1, 309.1, 309.4, 309.8, 309.9, 52/831, 847, 232

See application file for complete search history.

(56) References Cited

U.S. PATENT DOCUMENTS

| | | | | | |
|---|---|---|---|---|---|
| 1,075,845 | A | * | 10/1913 | Mills | 52/843 |
| 3,552,079 | A | * | 1/1971 | Mortensen | 52/592.6 |
| 3,992,838 | A | * | 11/1976 | Vizziello | 52/233 |
| 4,224,774 | A | * | 9/1980 | Petersen | 52/404.1 |
| 4,344,263 | A | * | 8/1982 | Farmont | 52/233 |
| 4,344,265 | A | * | 8/1982 | Davidson | 52/745.15 |
| 4,503,648 | A | * | 3/1985 | Mahaffey | 52/223.7 |
| 4,713,921 | A | | 12/1987 | Minialoff et al. | |
| 4,852,322 | A | | 8/1989 | McDermid | |
| 4,937,122 | A | | 6/1990 | Talbert | |
| 5,209,036 | A | * | 5/1993 | Cancilliari | 52/309.4 |
| 5,269,109 | A | * | 12/1993 | Gulur | 52/309.9 |
| 5,279,089 | A | * | 1/1994 | Gulur | 52/309.11 |
| 5,285,615 | A | | 2/1994 | Gilmour | |
| 5,475,961 | A | | 12/1995 | Menchetti | |
| 5,554,429 | A | * | 9/1996 | Iwata et al. | 428/105 |
| 5,609,006 | A | | 3/1997 | Boyer | |
| 5,678,381 | A | * | 10/1997 | DenAdel | 52/836 |

(Continued)

FOREIGN PATENT DOCUMENTS

| | | | |
|---|---|---|---|
| EP | 0190818 | A2 | 8/1986 |
| WO | WO 2011123660 | A3 * | 2/2012 |

OTHER PUBLICATIONS

International Report on Patentability for International Application No. PCT/US2011/030752 dated Oct. 2, 2012 (6 pages).*

*Primary Examiner* — Rodney Mintz
(74) *Attorney, Agent, or Firm* — Jean Kyle

(57) ABSTRACT

Insulating material is sandwiched between one edge of a structural 2×4 and one edge of a structural 2×2 to form a 2×6 wall stud with a thermal break. While shapes, sizes and compositions of the structural members can vary, the insulated wall stud has the advantage of being the size of conventional lumber reducing installation cost.

13 Claims, 9 Drawing Sheets

(56) References Cited

U.S. PATENT DOCUMENTS

| | | | | |
|---|---|---|---|---|
| 5,701,708 | A * | 12/1997 | Taraba et al. | 52/309.9 |
| 5,720,144 | A | 2/1998 | Knudson et al. | |
| 5,735,092 | A * | 4/1998 | Clayton et al. | 52/309.9 |
| 6,125,608 | A | 10/2000 | Charlson | |
| 6,158,190 | A | 12/2000 | Seng | |
| 6,182,413 | B1 * | 2/2001 | Magnusson | 52/589.1 |
| 6,318,046 | B1 * | 11/2001 | Horsfield et al. | 52/847 |
| 7,823,351 | B2 * | 11/2010 | Tiberi et al. | 52/404.1 |
| 8,091,297 | B2 * | 1/2012 | Tiberi et al. | 52/204.2 |
| 8,230,659 | B2 * | 7/2012 | Langille et al. | 52/741.3 |
| 8,516,778 | B1 * | 8/2013 | Wilkens | 52/847 |
| 8,826,616 | B1 * | 9/2014 | Gosselin | 52/309.3 |
| 2005/0050847 | A1 * | 3/2005 | Lott | 52/782.1 |
| 2006/0254197 | A1 | 11/2006 | Tiberi et al. | |
| 2007/0113506 | A1 | 5/2007 | Denadel | |
| 2007/0130865 | A1 * | 6/2007 | Nusz et al. | 52/481.1 |
| 2007/0130866 | A1 * | 6/2007 | Lott | 52/481.1 |
| 2007/0141343 | A1 * | 6/2007 | Miller et al. | 428/408 |
| 2007/0148434 | A1 * | 6/2007 | Miller et al. | 428/312.2 |
| 2007/0227095 | A1 | 10/2007 | Hubbe | |
| 2007/0283661 | A1 | 12/2007 | Daniels | |
| 2008/0008883 | A1 * | 1/2008 | Miller et al. | 428/408 |
| 2008/0060282 | A1 * | 3/2008 | Miller et al. | 52/79.1 |
| 2009/0065134 | A1 | 3/2009 | Jensen | |
| 2009/0205277 | A1 * | 8/2009 | Gibson | 52/309.9 |
| 2010/0037542 | A1 * | 2/2010 | Tiberi et al. | 52/204.2 |
| 2010/0175322 | A1 * | 7/2010 | Lee et al. | 49/70 |
| 2010/0236172 | A1 | 9/2010 | Wirth | |
| 2011/0318566 | A1 * | 12/2011 | Miller et al. | 428/312.2 |
| 2012/0011793 | A1 * | 1/2012 | Clark et al. | 52/309.4 |
| 2013/0283713 | A1 * | 10/2013 | Martens | 52/309.1 |
| 2013/0344760 | A1 * | 12/2013 | Snider | 442/181 |
| 2014/0033627 | A1 * | 2/2014 | Stephens et al. | 52/204.5 |
| 2014/0260003 | A1 * | 9/2014 | Elsarrag et al. | 52/173.3 |

* cited by examiner

WALL STUD WITH A THERMAL BREAK

CROSS-REFERENCE TO RELATED APPLICATIONS

This application claims the benefits of U.S. Provisional Application No. 61/319,620, filed Mar. 31, 2010, and U.S. Provisional Application No. 61/324,826, filed Apr. 16, 2010, the disclosures of which are hereby incorporated by reference in their entirety including all figures, tables and drawings.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

Building "green" not only means using recyclable and sustainable materials, it also means building the most cost effective and energy efficient buildings possible. Sustainable materials include lumber of a smaller diameter or composite materials. Building an energy efficient home requires using as much insulation as possible and reducing heat loss. A source of heat loss is wall studs. The wall studs in a home or building transfer heat and cold. Heat and cold are transferred through a wall from the inside of the structure to the outside of the structure by lumber wall studs. Steel studs are sometimes used in place of lumber to reduce cost. Steel studs however likewise transfer heat and cold. This problem has been addressed by providing a variety of insulated steel wall studs (see, for example, U.S. Pat. Nos. 4,713,921; 5,285,615; 5,475,961; 5,609,006; 5,720,144; 6,158,190, and U.S. Published Patent Application No. 2007/0113506 A1). Steel studs are not the first choice of a "green" builder however and they can be difficult to include in a structure designed for lumber studs. Insulated wall panels and variations of structural members have been presented to address thermal transfer (U.S. Pat. Nos. 4,937,122; 6,125,608; and U.S. Published Patent Application Nos. 2006/0254197A1; 2007/0130865 A1; 2007/0227095A1; 2007/0283661 A1; and 2010/0236172 A1). These too have proved insufficient in providing a cost effective means of building energy efficient structures.

A need therefore remains for a cost effective means by which to stop heat transfer across wall studs in new or remodeled homes or buildings. The means is preferably a green building option allowing the use of sustainable materials while providing an energy efficient building.

All patents, patent applications, provisional patent applications and publications referred to or cited herein, are incorporated by reference in their entirety to the extent they are not inconsistent with the teachings of the specification.

BRIEF SUMMARY OF THE INVENTION

An insulated stud provides a thermal break allowing a builder to create an insulating envelope at the exterior or interior of a building. The wall stud with a thermal break can be constructed in the dimension of conventional lumber so installation costs are not increased and structural integrity remains intact. In a preferred embodiment, the subject insulated stud comprises ½ inch of condensed foam insulation sandwiched between a 2×4 and a 2×2 piece of dimensional lumber. The resulting wall stud with a thermal break is the dimension of a conventional 2×6 stud allowing installation of insulation within the wall of the maximum R value. A machine that can make the subject insulated stud is also described.

DETAILED DESCRIPTION OF THE INVENTION

The invention involves insulated building materials, and in a specific embodiment, an insulated wall stud, that when used in construction provides a thermal envelope at the interior or exterior of the building.

Preferred embodiments of the insulated building material are shown in the appended figures. The exemplified embodiments show a wall stud. Insulating material 10 is sandwiched between an elongated first structural member 12 and an elongated second structural member 14. In the exemplified embodiments the structural members are pieces of dimensional lumber. Applicant notes however that the subject structural member can be made from post products, composites, or engineered wood products. Further, although the exemplified embodiments show a wall stud, the subject invention can be configured for use as any building material where a thermal break is desired.

The structural members sandwich insulating material to provide a thermal break across the stud. In the exemplified embodiment, the insulating material 10 is a condensed foam. Applicant notes however the insulating material can be any material that provides the necessary thermal break. Insulating material can include, but is not limited to, polyurethane, air, paper, plastic, prefabricated or engineered inserts of like materials, or like materials used singularly or together. Heat and cold transferred through the stud material is stopped by the thermal break.

Figure 1:
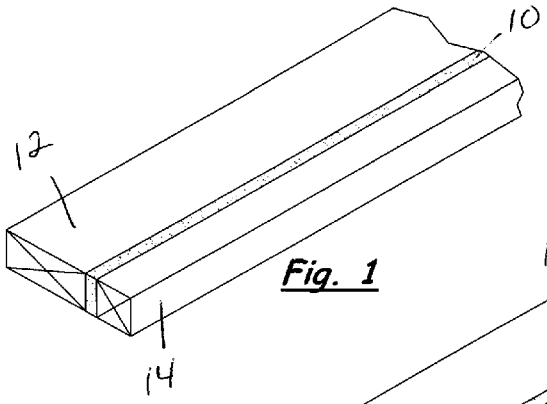
FIG. 1 is a partial side perspective view of a preferred embodiment of a wall stud with a thermal break of the subject invention.

In a particularly preferred embodiment the elongated structural members 12, 14 of the insulated wall stud of the subject invention are dimensional lumber. Using dimensional lumber to form the subject studs allows a builder to create a more energy efficient structure while allowing the builder to provide a structure that conforms to standard building practices. Further, the smaller dimensional lumber used to create the subject insulated wall studs are more easily obtained from sustainable resources. In the exemplified embodiment shown in FIG. 1, a standard stud 2×4 and a 2×2 of dimensional lumber are the first structural member and the second structural member, 12, 14 respectively. The 2×4 has two elongated sides, two elongated edges, and two ends. As is well known in the art, the true dimensions of these pieces are 1½ inches×3½ inches, and 1½ inches×1½ inches, respectively. The 2×4 and the 2×2 edge to edge sandwich an elongated ½ inch piece of compressed foam insulation 10. The insulation is glued, pressed, or keyed to each edge. The final product has the dimension of a 2×6, or 1½ inches×5½ inches. The subject stud therefor has the advantage of being the size of traditional dimensional lumber. This allows the subject wall stud with a thermal break to be used in plans designed for conventional lumber and does not add to the architectural or construction costs. Additions to a structure are seamless since the new, better insulated, addition conforms to the original structure meaning door and windows can be matched. Further, 2×6 studs are used in the construction of homes and businesses to provide a wall cavity to hold more insulation to achieve maximum R values. Therefore, these buildings not only have walls with a maximized R value but the insulated studs provide a thermal break from the transfer of heat and cold from the outside to the inside of the building. Additionally, it is noted that no structural integrity is lost with the insulated stud. The exemplified stud has the structural strength of at least an intact 2×4 piece of dimensional lumber.

Figure 8:
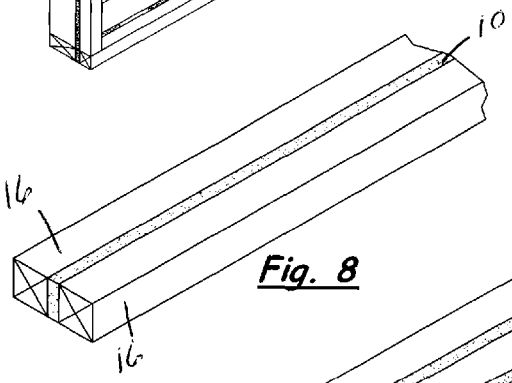
FIG. 8 is a partial side perspective view of a preferred embodiment of a wall stud with a thermal break of the subject invention with the depth of a dimensional lumber 2×4.
Figure 9:
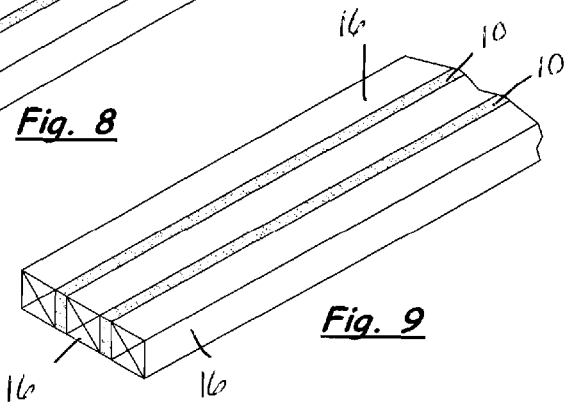
FIG. 9 is a partial side perspective view of a preferred embodiment of a wall stud with a thermal break of the subject invention with the depth of a dimensional lumber 2×6.
Figure 10:
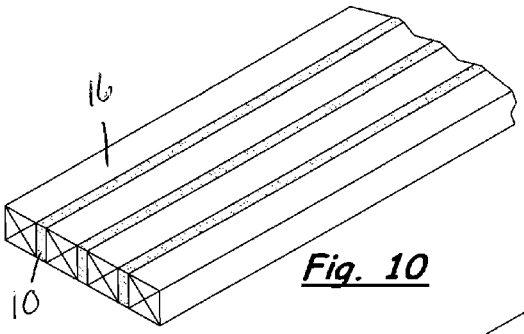
FIG. 10 is a partial side perspective view of a preferred embodiment of a wall stud with a thermal break of the subject invention with the depth of a dimensional lumber 2×8.
Figure 11:
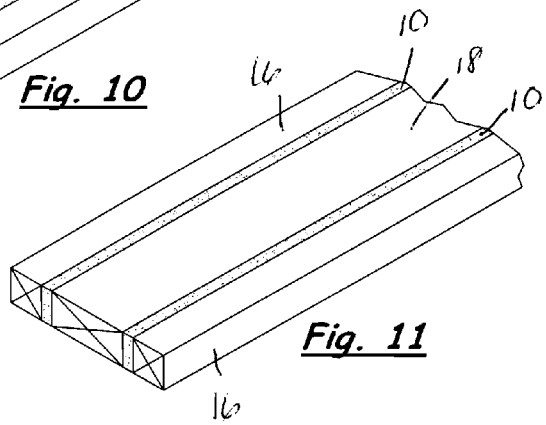
FIG. 11 is a partial side perspective view of another preferred embodiment of a wall stud with a thermal break of the subject invention with the depth of a dimensional lumber 2×8.
Figure 12:
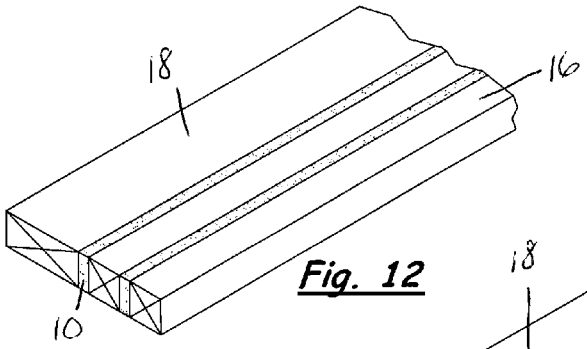
FIG. 12 is a partial side perspective view of another preferred embodiment of a wall stud with a thermal break of the subject invention with the depth of a dimensional lumber 2×8.
Figure 13:
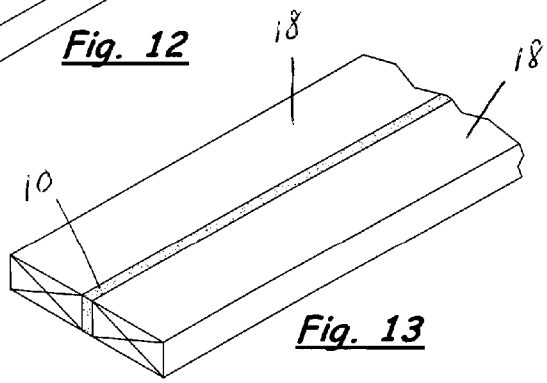
FIG. 13 is a partial side perspective view of another preferred embodiment of a wall stud with a thermal break of the subject invention with the depth of a dimensional lumber 2×8.
Figure 14:
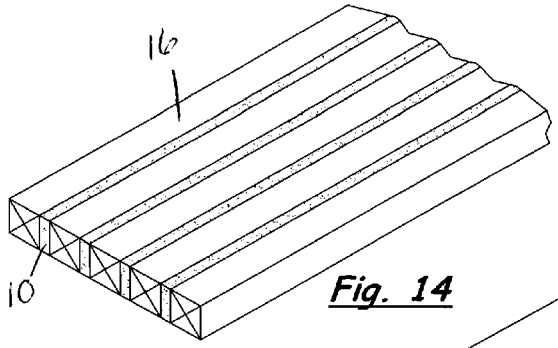
FIG. 14 is a partial side perspective view of a preferred embodiment of a wall stud with a thermal break of the subject invention with the depth of a dimensional lumber 2×10.
Figure 15:
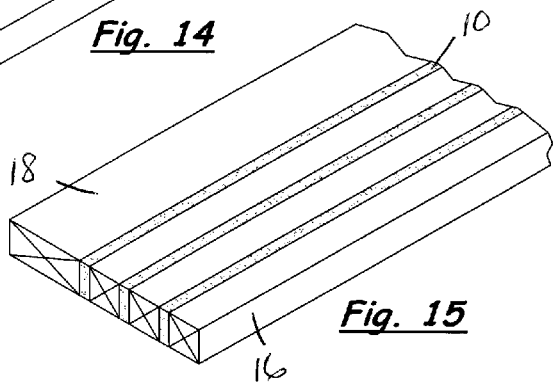
FIG. 15 is a partial side perspective view of another preferred embodiment of a wall stud with a thermal break of the subject invention with the depth of a dimensional lumber 2×10.
Figure 16:
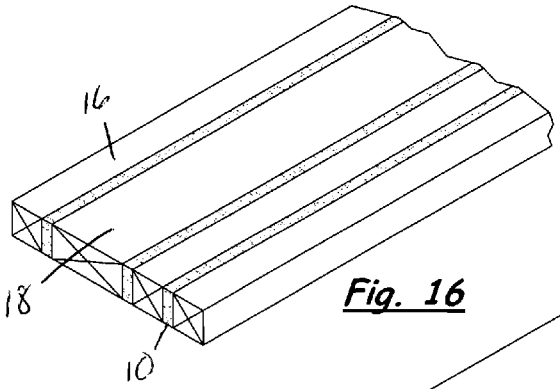
FIG. 16 is a partial side perspective view of another preferred embodiment of a wall stud with a thermal break of the subject invention with the depth of a dimensional lumber 2×10.
Figure 17:
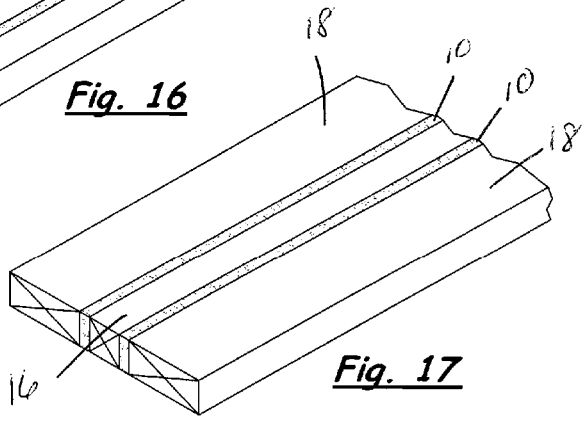
FIG. 17 is a partial side perspective view of another preferred embodiment of a wall stud with a thermal break of the subject invention with the depth of a dimensional lumber 2×10.
Figure 18:
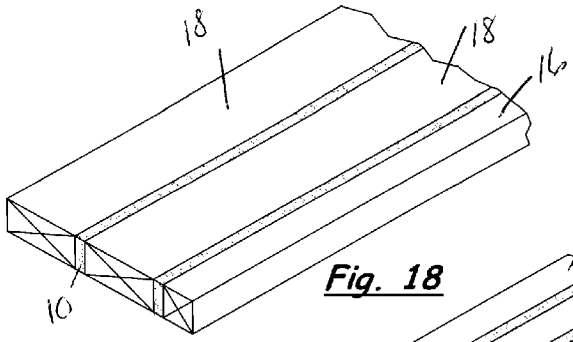
FIG. 18 is a partial side perspective view of another preferred embodiment of a wall stud with a thermal break of the subject invention with the depth of a dimensional lumber 2×10.
Figure 19:
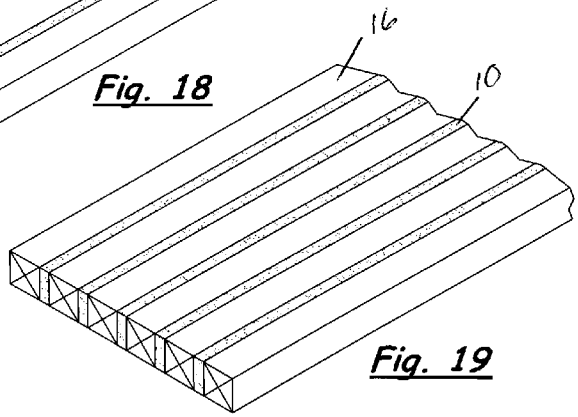
FIG. 19 is a partial side perspective view of a preferred embodiment of a wall stud with a thermal break of the subject invention with the depth of a dimensional lumber 2×12.
Figure 20:
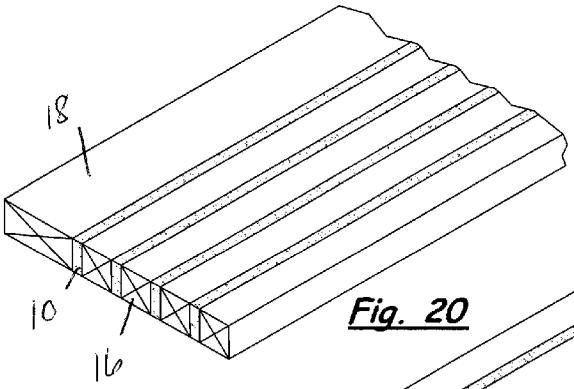
FIG. 20 is a partial side perspective view of another preferred embodiment of a wall stud with a thermal break of the subject invention with the depth of a dimensional lumber 2×12.
Figure 21:
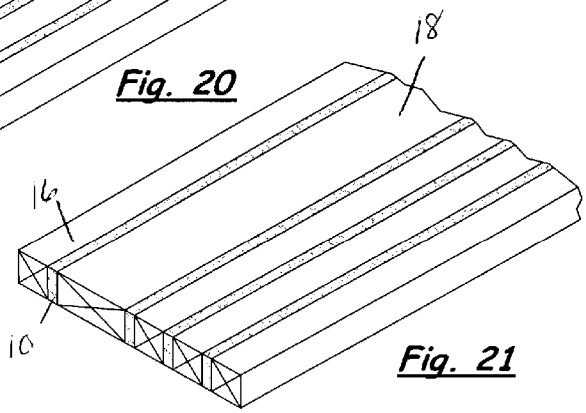
FIG. 21 is a partial side perspective view of another preferred embodiment of a wall stud with a thermal break of the subject invention with the depth of a dimensional lumber 2×12.
Figure 22:
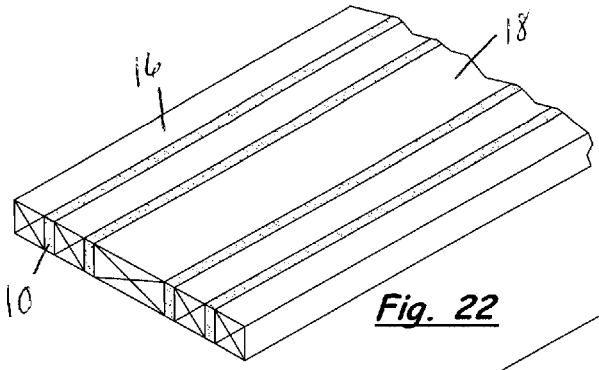
FIG. 22 is a partial side perspective view of another preferred embodiment of a wall stud with a thermal break of the subject invention with the depth of a dimensional lumber 2×12.
Figure 23:
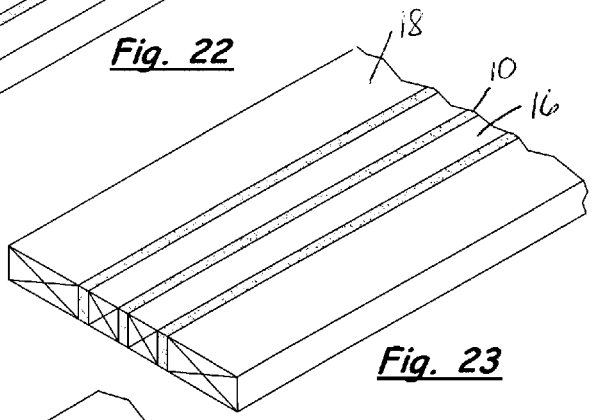
FIG. 23 is a partial side perspective view of another preferred embodiment of a wall stud with a thermal break of the subject invention with the depth of a dimensional lumber 2×12.
Figure 24:
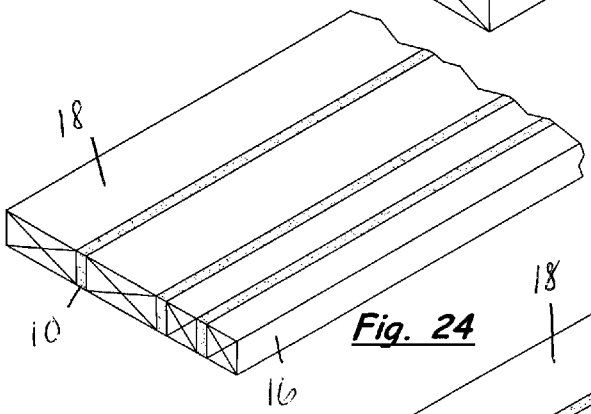
FIG. 24 is a partial side perspective view of another preferred embodiment of a wall stud with a thermal break of the subject invention with the depth of a dimensional lumber 2×12.
Figure 25:
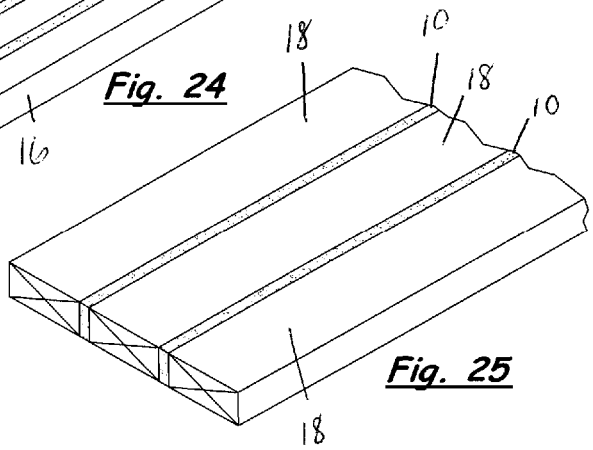
FIG. 25 is a partial side perspective view of another preferred embodiment of a wall stud with a thermal break of the subject invention with the depth of a dimensional lumber 2×12.

FIGS. 8-25 show other preferred embodiments of the wall stud with a thermal break of the subject invention. The embodiments illustrate the creation of insulated wall studs that have the depth of dimensional lumber 2×4, 2×6, 2×8, 2×10, and 2×12 s. Each embodiment has at least a first and at least a second elongated structural member with insulating material therebetween. For purposes of illustration the embodiments shown are created from dimensional lumber to create studs with a depth of dimensional lumber in the United States. One skilled in the art understands any size and dimension of pieces can be combined to achieve an insulated stud member of any depth. Further, although the depth of the insulating material is conveniently used at ½ inch in the exemplified embodiments. The depth of the insulating material between the structural members can be varied to effect the overall depth of the product. The exemplified embodiments use a combination of dimensional 2×4 and 2×6 structural members to create insulated wall studs with the depth of dimensional lumber. For example, FIG. 8 shows two dimensional 2×2 structural members 16 separated by insulating material 10 to form an insulated wall stud with a depth of a dimensional lumber 2×4. Three 2×2 structural members 16 create an insulated stud 2×6 in FIG. 9. Insulating material 10 is sandwiched between each structural member to provide an insulated stud with two thermal breaks. Dimensional lumber 2×4 structural members 18 are also used in the exemplified embodiments to create the insulated wall studs of the subject invention. For example, FIG. 11 shows an insulated wall stud with the depth of a dimensional lumber 2×8 made from two 2×2 structural members 16 and one 2×4 structural member 18. FIG. 17 shows a 2×10 formed from two 2×4 structural members 18 and one 2×2 structural member 16 while FIG. 25 shows a 2×12 made from three 2×4 structural members 18.

Figure 2:
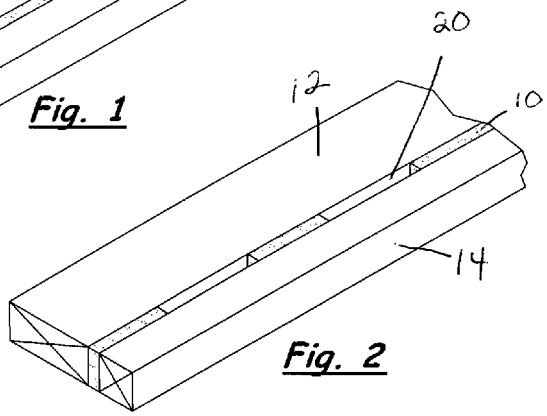
FIG. 2 is a partial side perspective view of another preferred embodiment of a wall stud with a thermal break of the subject invention.
Figure 3:
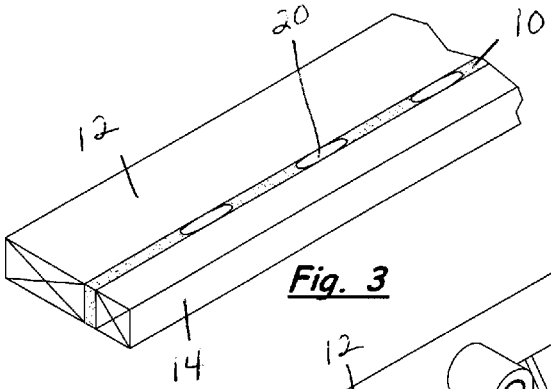
FIG. 3 is a partial side perspective view of another preferred embodiment of a wall stud with a thermal break of the subject invention.
Figure 7:
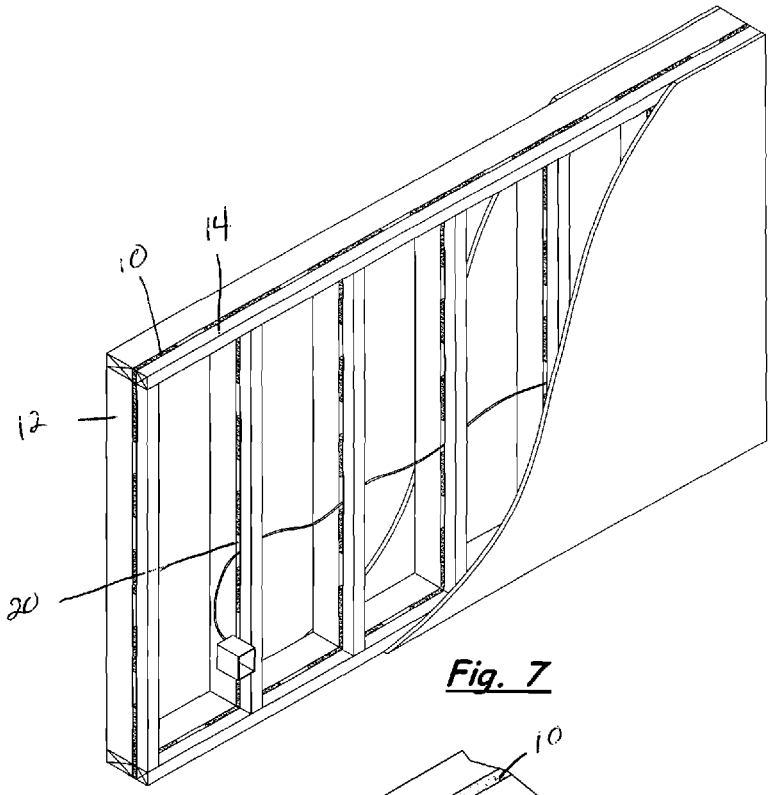
FIG. 7 is a cut-away partial rear perspective view of a wall constructed from the wall stud with a thermal break shown in FIG. 2 where breaks in the insulating material are used as an electrical chase.

FIGS. 2 and 3 show that the insulating material 10 of the insulated wall stud of the subject invention does not have to be continuous. Breaks or holes 20 in the insulating material can provide distinct advantages. When the breaks or holes are left void, the air trapped in the wall serves as insulating material. In some instances the air will be a better insulator than the other present insulating material. Further, the holes or voids can be used as electrical or plumbing chases as shown in FIG. 7.

Figure 4:
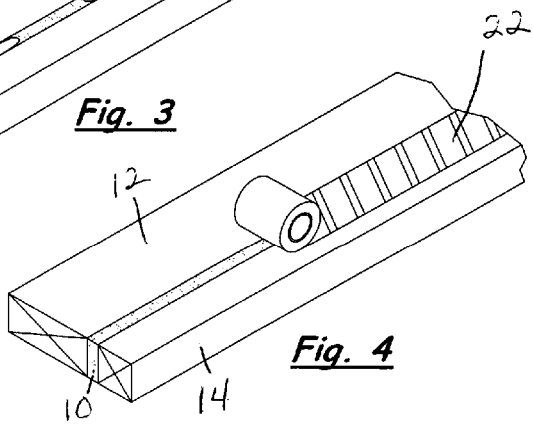
FIG. 4 is a partial side perspective view of another preferred embodiment of a wall stud with a thermal break of the subject invention with fire resistant tape covering the thermal break.
Figure 5:
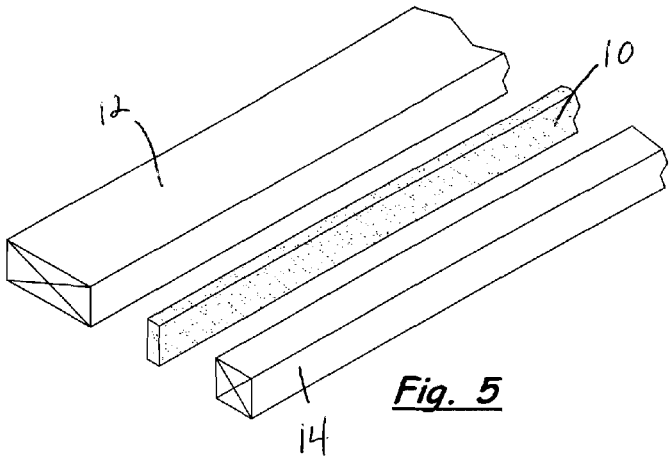
FIG. 5 is a partial exploded side perspective view of the preferred embodiment of a wall stud with a thermal break shown in FIG. 1.
Figure 6:
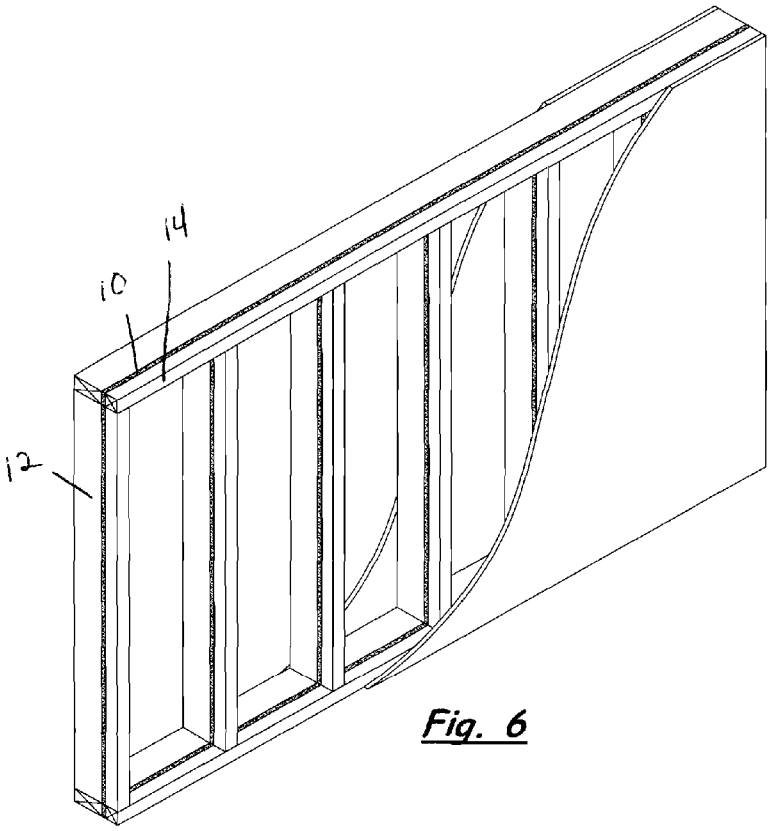
FIG. 6 is a cut-away partial rear perspective view of a wall constructed from the wall stud with a thermal break shown in FIG. 1.

In some cases, the insulating material of the subject invention can be considered to reduce the fire resistance of the subject wall stud. In preferred embodiments, fire resistant materials can be included in the subject invention. Fire resistant materials can be incorporated into the insulating material. The structural members can be treated for fire resistance, or alternatively, a fire resistant tape 22 can be applied over the exposed insulated material to provide fire protection (FIG. 4). Alternatively, fire resistant material can encapsulate the entire insulated stud.

The insulated building material of the subject invention can be made by a variety of means. These means include, but are not limited to, applying glue and pressure to necessary components to create the finished product. The thermal stud of the subject invention can likewise be produced without any glue or bonding agent, by pressing or sliding the foam member into a configured saw or router channel in the two wood members to create a single piece. The subject thermal stud can also be manufactured by spraying, pouring, or injecting the foam or thermal product into a cavity between the two wood members. The foam adheres to the two wood members allowing the piece to be formed in a single process. Manufacturing can be manual, or powered by electrical or gas, and can be assisted by computer mechanized machines.

Figure 26:
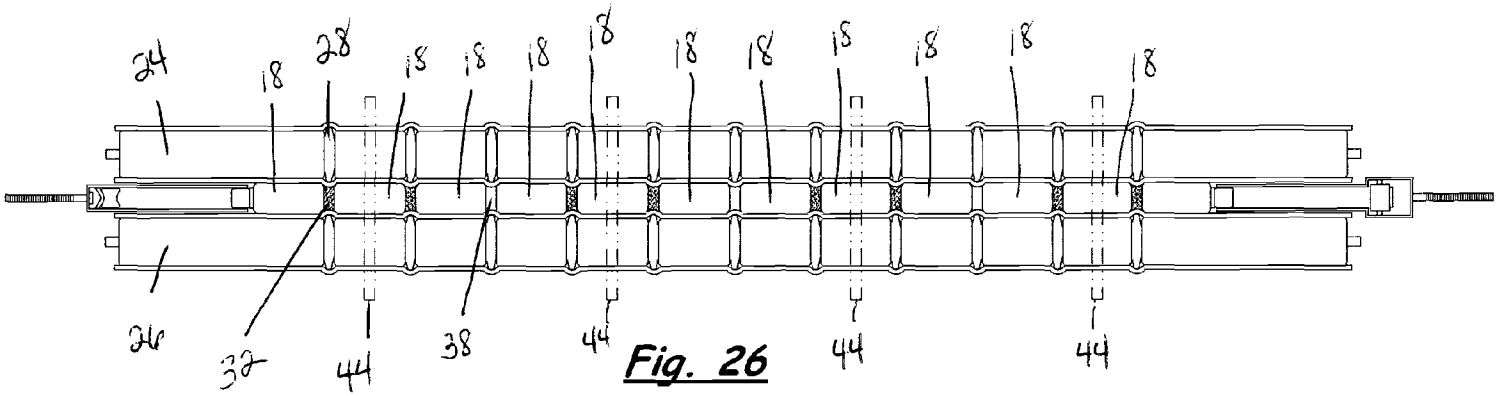
FIG. 26 is front end view of the conveyor assembly of a preferred embodiment of a machine to make the wall stud with a thermal break of the subject invention.
Figure 27:
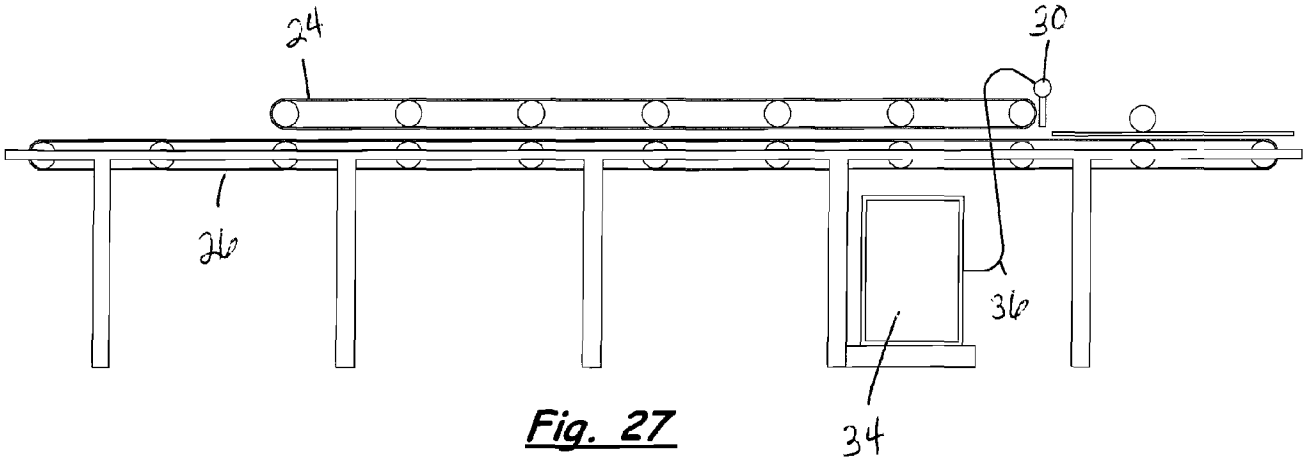
FIG. 27 is a partial side view of the conveyor assembly and sprayer unit of the machine shown in FIG. 26.
Figure 28:
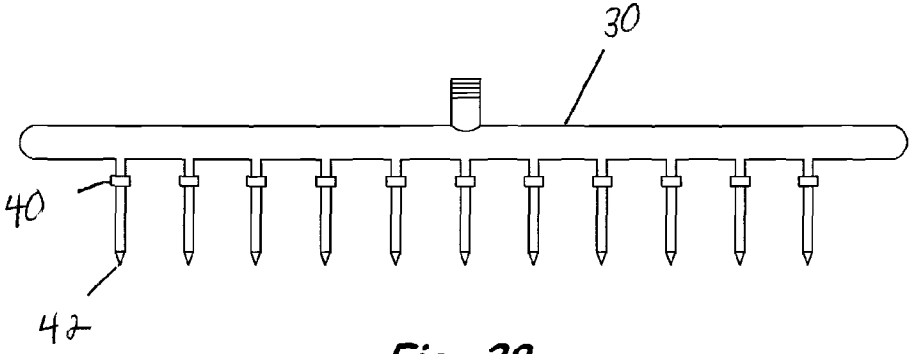
FIG. 28 is a side view of a preferred embodiment of a sprayer head for the machine shown in FIG. 26.

FIGS. 26-29 show a preferred machine for making the subject insulated wall stud with a thermal break. Insulating foam is sprayed into spaces between structural members created by a conveyor. A lower conveyor belt and an upper conveyor belt move a plurality of structural members side by side through the machine (FIG. 26). Rollers maintain the spacing between members. A multi-tip sprayer spitter sprays foam into the spaces. The foam adheres to the edges of the structural members to created a single unit. The unit is then sawed along saw lines lengthwise to create the thermal studs. In the exemplified embodiment, 2×4 structural members 18 are spaced by rollers 28 along conveyors 24, 26. Spray head 30 applies foam 32 from the spray foam reactor 34 through the spray hose 36 (FIG. 27) into the spaces 38 to fuse three 2×4 members together as a single unit. Spray head 30 has shut off valves 40 to allow controlled application by the spray tips 42 (FIG. 28). The three fused 2×4 structural members fused into a single unit are sawed lengthwise along saw lines 44 to create two 2×6 insulated studs. The exemplified machine produces eight 2×6 studs. Fire resistant tape 22 can be applied to the stud after the spray foam injection process or during and/or after the saw process. Voids 20 in the foam material as shown in FIGS. 2 and 3 can be created by applying the foam in a pulsing manner. Alternatively, the voids can be created by punching, pressing, or cutting foam material from the layer after the foam injection or saw process.

Figure 29:
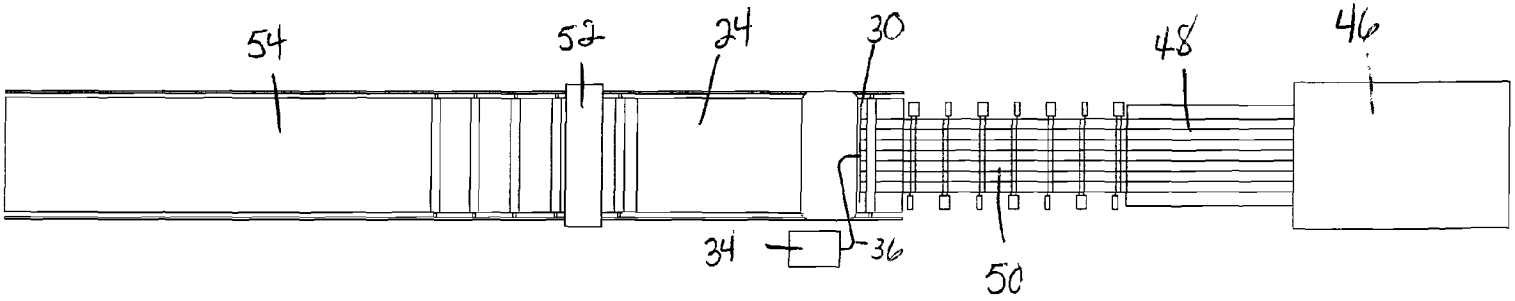
FIG. 29 is a top view of the machine shown in FIG. 26.

Preferably, the machine also includes a material feeding section 46 for holding bulk material and a material separating section 48 to prepare the bulk material to be placed on the conveyor (FIG. 29). Material is positioned on the conveyor in the material positioning section 50 where it is run through the conveyor section and foam is applied. A saw 52 cuts the fused units into insulated wall studs with the desired depth and a conveyor 54 carries them to storage. It is noted that the shut off valves 40 on the spray head 30 allows injection lines to be positioned and controlled so that the machine can be configured to produce insulated studs ranging from 2×4 s to 2×12 s.

The insulated building material of the subject invention can be used as a standard structural stud, top and bottom structural plate, and roof framing with dimensional or engineered wood products, also as engineered truss cords, in the framing process. It can also be used in truss design and in vaulted ceilings. As noted, the exemplified studs can be incorporated into a building without added cost of labor, and while conforming to industry standards. Currently, builders and architects are designing buildings with twice the materials and leaving all doors and window openings with oversized jams to achieve a thermal break. This results in unnecessary added cost in the materials and labor. The subject invention allows a thermal break to be applied to any existing wood product in various shapes and sizes without compromising structural integrity. The thermal break also has sound reduction qualities.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. An insulated wall stud, comprising:

at least a first elongated structural member, the at least first elongated structural member having a first depth of dimensional lumber;

at least a second elongated structural member, the at least second elongated structural member having a second depth of dimensional lumber;

each elongated structural member has a width, the width of the at least first elongated structural member is equal to the width of the at least second elongated structural member;

insulating material sandwiched between the widths of the elongated structural members, the insulating material having a thickness less than the first depth of the first elongated structural member and less than the second depth of the second elongated structural member, wherein the at least first elongated structural member, the at least second elongated structural member and the insulating material are connected to prevent thermal bridging;

wherein each elongated structural member is at least a 2×2 piece of dimensional lumber, the first depth of the at least first elongated structural member, the second depth of the at least second elongated structural member and the thickness of the insulating material combine to form the insulated wall stud that has a combined depth of dimensional lumber; and wherein said insulating material comprises at least one of (a) a fire resistant material and (b) voids and is non-continuous.

2. The insulated wall stud of claim 1, wherein said fire resistant material is fire resistant tape covering said insulating material.

3. The insulated wall stud of claim 1, wherein said at least first elongated structural member and said at least second elongated structural member are made of material selected from the group consisting of solid wood, engineered wood, and composite materials.

4. The insulated wall stud of claim 1, wherein said insulating material is made of material selected from the group consisting of plastics, paper, air, condensed foam, and composite materials.

5. The insulated wall stud of claim 1, wherein said width of the at least first elongated structural member is a first width and said width of the at least second elongated structural member is a second width, and wherein said first depth and said first width of said at least first elongated structural member, said thickness of said insulating material, and said second depth and said second width of said at least second elongated structural member combine to form said insulated wall stud with a combined width and said combined depth of dimensional lumber.

6. The insulated wall stud of claim 1, wherein said at least first elongated structural member is a 2×4 piece of dimensional lumber, said at least second elongated structural member is a 2×2 piece of dimensional lumber and said thickness of said insulating material is ½ inch to combine to form said insulated wall stud having the combined depth of a 2×6 piece of dimensional lumber.

7. The insulated wall stud of claim 1, wherein said at least first elongated structural member is a 2×2 piece of dimensional lumber, said at least second elongated structural member is a 2×2 piece of dimensional lumber and further comprising a third elongated structural member that is a 2×2 piece of dimensional lumber, said thickness of said insulating material is ½ inch to combine to form said insulated wall stud having the combined depth of a ×6 piece of dimensional lumber.

8. The insulated wall stud of claim 1, wherein said at least first elongated structural member is a 2×2 piece of dimensional lumber, said at least second elongated structural member is a 2×2 piece of dimensional lumber and said thickness of said insulating material is ½ inch to combine to form said insulated wall stud having the combined depth of a 2×4 piece of dimensional lumber.

9. The insulated wall stud of claim 1, wherein said at least first elongated structural member is a 2×4 piece of dimensional lumber, said at least second elongated structural member is a 2×4 piece of dimensional lumber and said thickness of said insulating material is ½ inch to combine to form said insulated wall stud having the combined depth of a 2×8 piece of dimensional lumber.

10. The insulated wall stud of claim 1, wherein said at least first elongated structural member is a 2×4 piece of dimensional lumber, said at least second elongated structural member is a 2×2 piece of dimensional lumber and further comprising a third elongated structural member that is a 2×2 piece of dimensional lumber, said thickness of said insulating material is ½ inch to combine to form said insulated wall stud having the combined depth of a 2×8 piece of dimensional lumber.

11. The insulated wall stud of claim 1, wherein said at least first elongated structural member is a 2×4 piece of dimensional lumber, said at least second elongated structural member is a 2×4 piece of dimensional lumber and further comprising a third elongated structural member that is a 2×2 piece of dimensional lumber, said thickness of said insulating material is ½ inch to combine to form said insulated wall stud having the combined depth of a 2×10 piece of dimensional lumber.

12. The insulated wall stud of claim 1, wherein said at least first elongated structural member is a 2×4 piece of dimensional lumber, said at least second elongated structural member is a 2×4 piece of dimensional lumber and further comprising a third elongated structural member that is a 2×4 piece of dimensional lumber, said thickness of said insulating material is ½ inch to combine to form said insulated wall stud having the combined depth of a 2×12 piece of dimensional lumber.

13. The insulated wall stud of claim 1, wherein said at least first elongated structural member is a 2×4 piece of dimensional lumber, said at least second elongated structural member is a 2×4 piece of dimensional lumber, further comprising a third elongated structural member that is a 2×2 piece of dimensional lumber, and further comprising a fourth elongated structural member that is a 2×2 piece of dimensional lumber, said thickness of said insulating material is ½ inch to combine to form said insulated wall stud having the combined depth of a 2×12 piece of dimensional lumber.

* * * * *